US005105751A

United States Patent [19]

Ulmen et al.

[11] Patent Number: 5,105,751

[45] Date of Patent: Apr. 21, 1992

[54] PROCESS FOR CARRYING OUT A SEWING OPERATION WITH A SEWING MACHINE WITH NEEDLE FEED

[75] Inventors: Mathias Ulmen, Kindsbach; Dieter Balzer, Heiligenmoschel; Heinrich Bungert, Kaiserslautern, all of Fed. Rep. of Germany

[73] Assignee: PFAFF Industriemaschinen GmbH, Kaiserslautern, Fed. Rep. of Germany

[21] Appl. No.: 466,318

[22] PCT Filed: Apr. 1, 1989

[86] PCT No.: PCT/EP89/00352

§ 371 Date: May 4, 1990

§ 102(e) Date: May 4, 1990

[87] PCT Pub. No.: WO89/10992

PCT Pub. Date: Nov. 16, 1989

[30] Foreign Application Priority Data

May 5, 1988 [DE] Fed. Rep. of Germany ..... 3815303

[51] Int. Cl.[5] ..... D05B 27/14; D05B 69/18

[52] U.S. Cl. ..... 112/310; 112/318; 112/262.7; 112/121.13; 112/316

[58] Field of Search ..... 112/121.13, 262.1, 303, 112/310, 317, 318, 322, 321, 443, 446, 447, 450, 451

[56] References Cited

U.S. PATENT DOCUMENTS

| | | | |
|---|---|---|---|
| 2,669,206 | 2/1954 | Pinkvoss et al. | 112/322 |
| 3,216,386 | 11/1965 | Bono | 112/310 |
| 4,182,252 | 1/1980 | Yoneji et al. | 112/317 |
| 4,513,676 | 4/1985 | Martell et al. | 112/262.1 |
| 4,643,118 | 2/1987 | Bungert et al. | 112/318 |
| 4,671,197 | 6/1987 | Bungert et al. | 112/310 |
| 4,860,677 | 8/1989 | Ishihara | 112/318 |

FOREIGN PATENT DOCUMENTS

| | | | |
|---|---|---|---|
| 3516713 | 4/1986 | Fed. Rep. of Germany . | |
| 3516715 | 11/1986 | Fed. Rep. of Germany . | |
| 0122495 | 9/1980 | Japan | 112/121.13 |
| 3139593 | 6/1988 | Japan | 112/303 |

*Primary Examiner*—Werner H. Schroeder
*Assistant Examiner*—Ismael Izaguirre
*Attorney, Agent, or Firm*—McGlew & Tuttle

[57] ABSTRACT

The invention describes a process for carrying out a sewing operation with a sewing machine having a needle feed.

In present sewing operations with a sewing machine having needle feed, defective stitches are often formed at the beginning, because the initial threads are not sufficiently clamped in the needle plate as a consequence of the elongated stitch hole. In the new process, the position of the needle prior to the beginning of sewing is displaced into an end zone of the stitch hole for performing a preselected number of initial stitches.

5 Claims, 7 Drawing Sheets

PROCESS FOR CARRYING OUT A SEWING OPERATION WITH A SEWING MACHINE WITH NEEDLE FEED

FIELD OF THE INVENTION

The present invention pertains in general to a sewing operation with a sewing machine driving both a needle, and an upper and/or lower feed means for feeding the fabric to be sewn, and specifically to a sewing operation for forming satisfactory initial stitches.

BACKGROUND OF THE INVENTION

In a sewing machine equipped with a needle oscillating in the direction of feed, the needle plate has a stitch hole designed as a slot. This stitch slot extends in the direction of feed. As a consequence of this, the interlock of the initial stitches, especially of the first stitch, will come undone due to the lack of friction between the threads at the edge of the stitch slot on the pulling by the thread lever, and satisfactory stitches will be prevented from forming. This happens mainly in the case of short thread ends after a thread cutting operation.

SUMMARY AND OBJECTS OF THE INVENTION

The object of the present invention is to provide a process in a sewing machine with needle feed which guarantees reliable stitch formation at the beginning of a new sewing operation.

This is accomplished in a process where the needle is displaced into an end zone of the stitch hole of the needle plate prior to the sewing operation. A preselected number of initial stitches are then formed in this position of the needle. The displacement of the needle is then abolished, and the feed motion of the fabric being sewn is corrected by the amount of the displacement.

The process according to the present invention makes it possible to substantially improve conditions for stitch formation at the very beginning of the seam formation by the sufficient clamping effect of the threads at the edge of the stitch slot and thereby to achieve reliable initial stitch formation.

An advantageous feature of the invention is that during the initial stitches, the needle can perform a feed motion corresponding to the feed motion of the fabric. The feed motion of the fabric being brought about by upper and lower feed means.

The process according to the invention can also be designed so that the needle is stopped in its displaced position during the initial stitching and the entire feed motion of the fabric is performed by the feed means only during the phase in which the needle is withdrawn from the fabric. After the axis of the needle returns to its normal position, the needle can be moved allowing feeding for the fabric both when the needle has penetrated the fabric and when it has been withdrawn. This feature allows both the entry and the exit of the needle into and from the fabric being sewn to take place in the immediate end zone of the stitch slot. As a result of which optimal clamping conditions are created for the free thread ends at the edge of the stitch slot.

It is also possible to have the feed motion turned off during the first stitch, causing a reduction of thread consumption during the first stitch formation and consequently a reduction of after pulling of the sewing threads through the thread lever.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
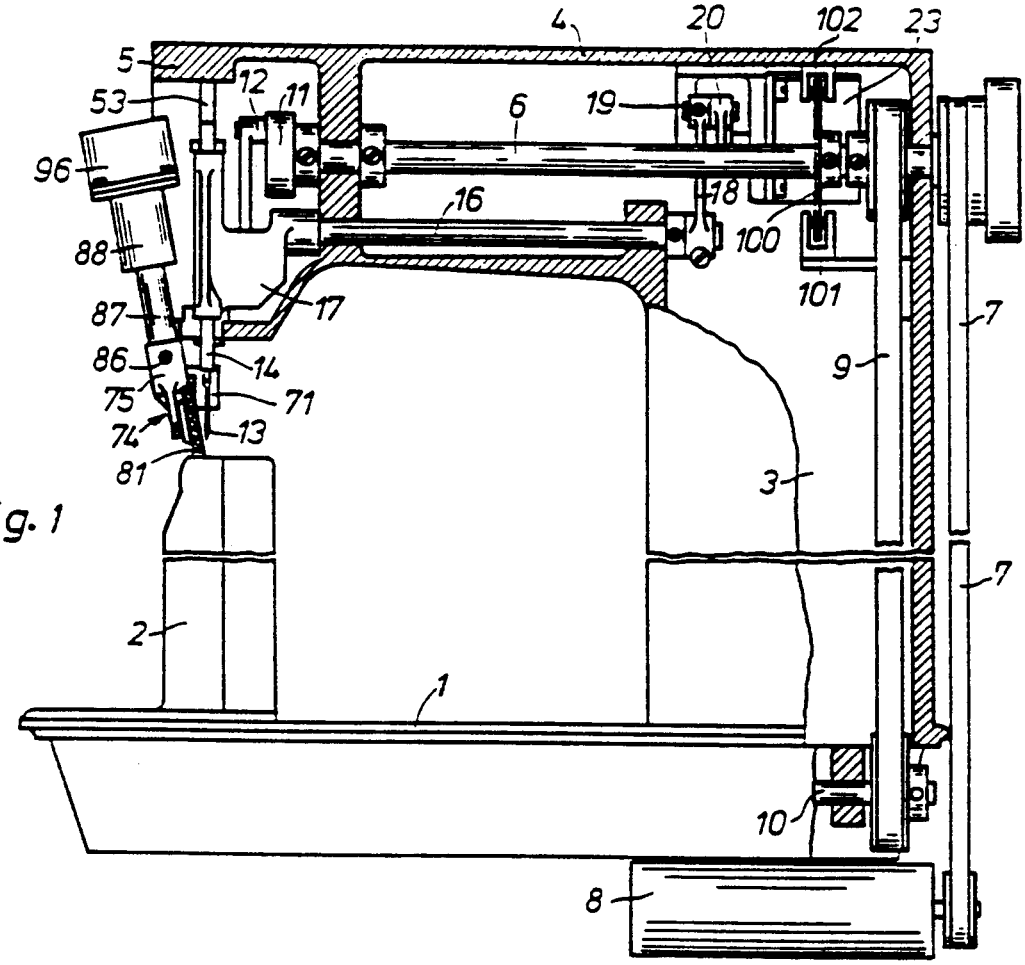
FIG. 1 is a synoptic, partially cut-away view of a sewing machine equipped with a needle feed mechanism.

Referring to the drawings and in particular to FIG. 1, the sewing machine consists of a, base plate 1, a column 2, a stand 3, a arm 4, and a head 5. A main shaft 6, which is driven by a sewing motor 8 mounted underneath the base plate 1 via a V-belt 7, is mounted in arm 4 in the usual manner. A shuttle shaft 10, which is in a driving connection with a shuttle (not shown), is driven by the main shaft 6 via a toothed belt 9.

Figure 2:
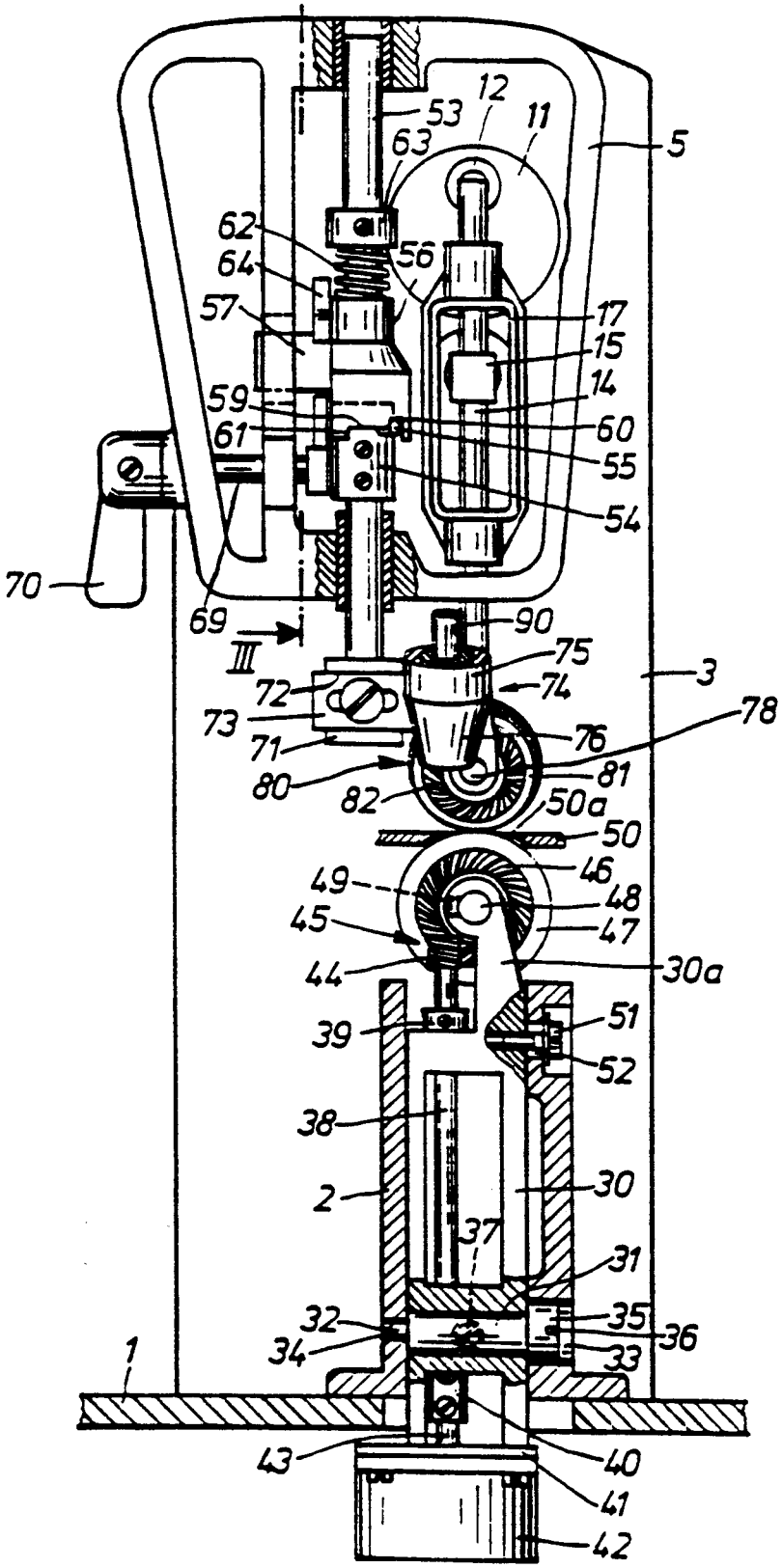
FIG. 2 is an enlarged, partially cut-away side view of the sewing machine according to FIG. 1.

The main shaft 6 drives via a crank 11 and a connecting rod 12, a needle bar 14 equipped with the needle 13. The connecting rod 12 is hinged to the needle bar 14 via a hinge connection 15 (FIG. 2). The needle bar 14 is mounted in a rocker arm 17 carried by a rocking shaft 16 (FIG. 1). The rocking shaft 16 is mounted in the arm 4 in parallel to the main shaft 6.

Figure 4:
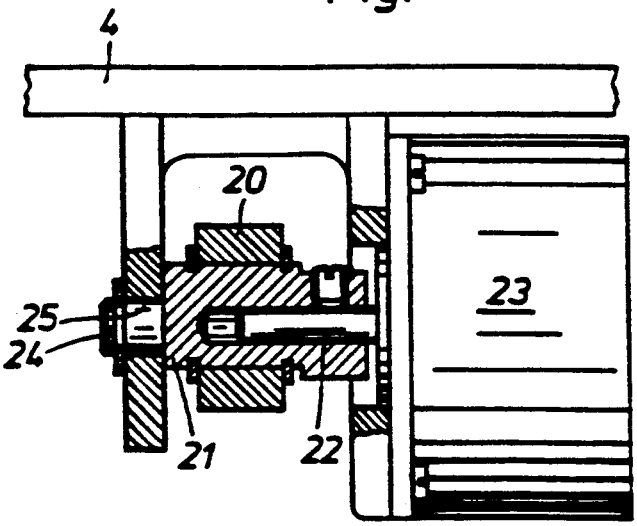
FIG. 4 is a partially cut-away rear view of the stepping motor drive for swinging out the needle bar.

The end of the rocking shaft 16 extending into the stand 3 carries a lever arm 18, which is connected to an eccentric rod 20 via a hinge pin 19. The eccentric rod 20 surrounds an eccentric 21 (FIG. 4), which is rigidly connected to a drive shaft 22 of a stepping motor 23 mounted in the arm 4. The eccentric 21 is guided with a pin 24 in a bore 25 of the arm 4, which bore extends coaxially to the drive shaft 22.

In the lower part of the column 2 (FIG. 2), a support 30 is mounted on an eccentric 31, which has pivot pins 34 and 35 extending into bores 32 and 33 provided in the column 2. The pivot pin 35 is provided with a slot 36. The eccentric 31 is clamped to the support 30 by a screw 37. An upright shaft 38, which is guided in the axial direction by an adjusting ring 39 and a coupling 40, is mounted in the support 30. The lower end of the support 30 is equipped with a flange plate 41, on which a stepping motor 42 is fastened, and the drive shaft 43 of this stepping motor is rigidly connected to the upright shaft 38 via the coupling 40. At its upper end, the upright shaft 38 carries a pinion 44 of a Spiroid gear mechanism 45, whose ring gear 46 is rigidly connected to a pushing wheel 47, which is mounted in a ball bearing in the known manner and has an inner part with an axle stub 48. The axle stub is received in a bore in an arm 30*a* of the support 30 and can be fixed with a screw 49 after adjustment in the axial direction.

The height of the pushing wheel 47 can be adjusted relative to a needle plate 50, which closes off the column 2 in the upward direction and through which the pushing wheel 47 extends through a slot 50*a*, by rotating the eccentric 31 by means of the slot 36. In parallel to the slot 50*a*, the needle plate 50 is provided with a stitch slot 50*b* for the passage of the needle 13.

The support 30 is firmly clamped to the column 2 by a screw 51, which is screwed into its upper part and extends through a slot 52 in the column 2.

A shaft 53 extending vertically is loosely mounted in the head 5 of the sewing machine. A clamping piece 54 is fastened by screws on the shaft 53. The clamping piece has a radial bore into which a pin 55 is inserted. A coupling piece 56 is loosely mounted on the shaft 53. A web 57, which is located on the side of the coupling piece 56, extends through a slot in the head 5 and secures the clamping piece 56 against rotation. The lower area of the coupling piece 56 is designed as an annular cutout, and thus it surrounds the clamping piece 54. The annular cutout has a recess 59 into which extends the pin 55. The annular cutout is formed at one of its ends with a locking groove 60, while its other end, is formed with a wall 61. A compression spring 62, which is supported by an adjusting ring 63 fastened on the shaft 53, gently presses the coupling piece 56 and consequently the upper wall of its annular cutout in the downward direction against the pin 55.

Figure 3:
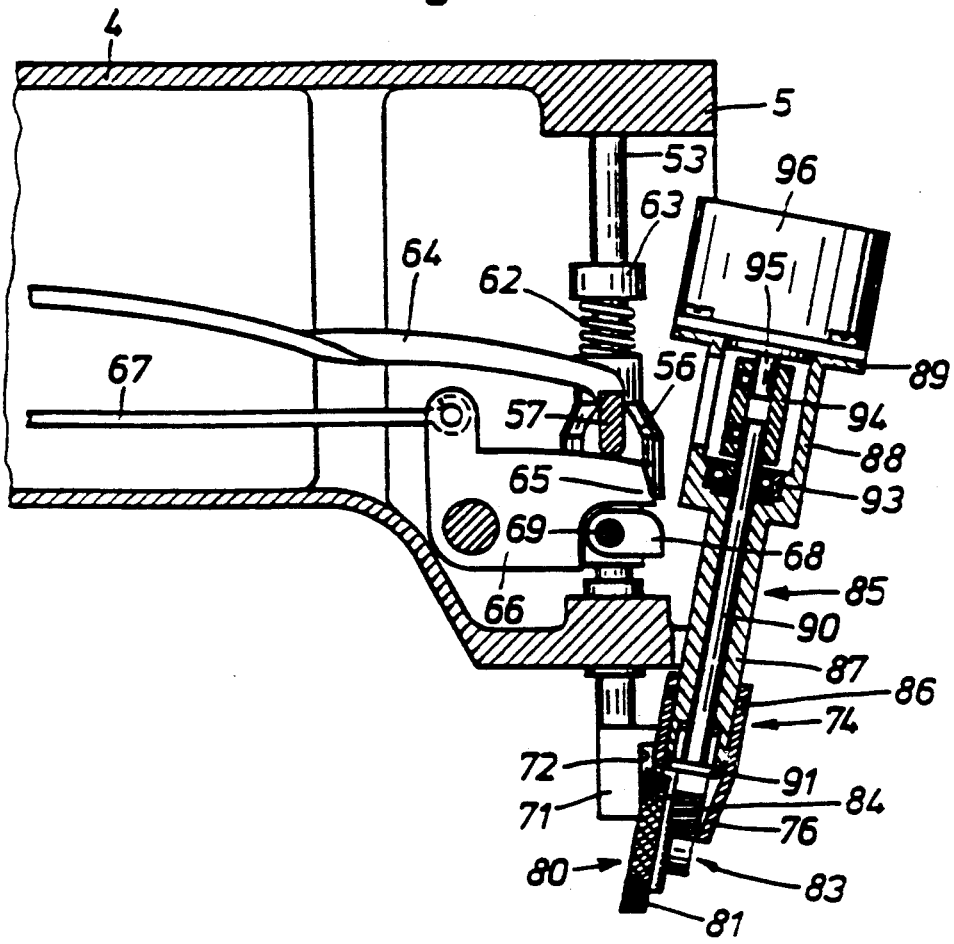
FIG. 3 is a sectional view along line III—III in FIG. 2.

The free end of a leaf spring 64, which is fastened in the arm 4 and presses the coupling piece 56 in the downward direction, lies on the web 57 (FIG. 3). A lever arm 65 of an angle lever 66 is mounted in the head 5 and is connected via a connecting rod 67 to a lever mechanism (not shown) that can be actuated by the sewing machine operator. The lever arm 65 reaches under the web 57. Under the lever arm 65, a cam 68 is fastened on a shaft 69 mounted in the head 5. The shaft 69 (FIG. 2) carries a hand lever 70 at its end extending to the outside.

A block 71, which is provided with a groove guide 72, is fastened at the lower end of the shaft 53. An angular tab 73, which has an elongated slot and is rigidly connected to a rolling foot support 74, is fastened in the groove guide by screws. The rolling foot support 74 has a pipe connection 75 (cf FIG. 3), which passes over into an end piece 76 extending downward. A bore for fastening an axle stub 78 of a rolling foot 80 is mounted in a ball bearing and is provided in the end piece. The rolling foot 80 has a race 81 to which a ring gear 82 of a Spiroid gear mechanism 83, whose pinion 84 eccentrically meshes with the ring gear 82, is rigidly connected. A tubular support 85, which is locked in its position by screws 86 is screwed into the pipe connection 75, is held in the pipe connection 75. The support 85 consists of a tube 87 joining a hollow cylinder 88 in the upward direction, and an annular connection flange 89. A shaft 90, whose lower end carries the pinion 84, rigidly connected to an annular shoulder 91, and abuts against the lower end of tube 87, is mounted in the tube 87.

In the zone of its upper end, the shaft 90 is surrounded by the inner ring of a ball bearing 93 pressed into the hollow cylinder 88. The upper end of the shaft 90 is rigidly coupled by a coupling 94 with a drive shaft 95 of a stepping motor 96, whose housing is fastened by screws to the closing annular flange 89.

An impulse disk 100, which has two impulse paths, each of which cooperates with a pulse generator 101 and 102, respectively, is fastened to the main shaft 6 (FIG. 1) of the sewing machine. One of the impulse paths has a plurality of impulse markings 103 (FIG. 5) distributed uniformly on the circumference of the disk 100, while the other impulse path has only two impulse markings 104. One of the two impulse markings 104 passes by the pulse generator 101 during the exit of the needle 13 from the part being sewn and the other impulse marking passes by it during the entry of the needle 13 into the part being sewn.

The pulse generator 101 is connected to a control unit 105. A selector 106 is connected to the control unit via a control line 106*a*. AND gates 107, 108 and 109 are connected to the control unit 105 via the control lines 107*a*, 108*a*, and 109*a*, and counters 111, 112, and 113 are connected to the control unit 105 via a transfer bus 110. In addition, a keyboard 114 is connected to the control unit 105 via a transfer bus 114*a*, a display unit 115 is connected via a transfer bus 115*a*, and a data storage unit 116 is connected via a transfer bus 116*a*. The AND gates 107, 108 and 109 can be switched to "ON", i.e., for transmission of impulses present at their inputs E1. This is done by their inputs E2 being switched by the control unit 105 to High via the control lines 107*a*, 108*a* and 109*a*. The AND gates are switched to "OFF," i.e., no transmission at their inputs E1 when their inputs E2 are switched to Low.

The outputs of the counters 111, 112, and 113 are connected to inputs of power amplifiers 117,118, and 119 for the corresponding stepping motor 23, 42, and 96. In addition, the outputs of the counters 111, 112, and 113 are connected to the control unit 105 via the lines 111*a*, 112*a*, and 113*a*. Lines 117*a*, 118*a*, and 119*a* lead from the control unit 105 to the power amplifiers 117, 118, and 119. Furthermore, three switches 120, 121, and 122 are connected to the control unit 105; among these switches, switch 120 is used to actuate a reverse sewing operation, while the two switches 121 and 122 are provided for the slow drive of the stepping motors 42 and 96 in the forward and reverse directions during stoppage of the sewing machine, preferably with the needle in the raised position. An oscillator 123 is connected for this purpose to the two power amplifiers 118 and 119 via a divider 124 and a switch 125. The switch 125 is connected to the control unit 105 via a control line 125*a*. The oscillator 123 is also connected to the input F1 of the selector 106. The selector input F2 is connected to the pulse generator 102. The output of the selector 106 is connected to the inputs E1 of the three AND gates 107, 108, and 109, whose outputs are connected to the corresponding counter 111, 112, and 113, which are designed as decremental counters and can be preset individually from the control unit 105 via the transfer bus 110.

The number of steps to be performed by the stepping motors 23, 42, and 96 per sewing stitch and hence the feed length of the individual feeding members—the needle 13, the pushing wheel 47, and the rolling foot 80—between the individual stitches can be preselected with the keyboard 114. It is also possible to select different amounts of feed of the pushing wheel 47 relative to the rolling foot 80. The size of the preselected stitch length is displayed in the display unit 115.

A motor control device 126 is connected to the control unit 105 via a transfer bus 126*a*. The motor control device 126 is intended especially for controlling the sewing motor 8 and is connected thereto via a line 8*a*. A speed set value generator 127, designed as a pedal-operated member, is connected to the motor control device 126 via a transfer bus 127*a*. A counter 128 is connected to the control unit 105 via a transfer bus 128*a* and a line 128*b*, and to the pulse generator 101 via a line 128*c*.

The device operates as follows:

The sewing machine operator selects the desired amounts of feed of the needle 13, the pushing wheel 47, and the rolling foot 80 via the keyboard 114. Corresponding digital values are then retrieved from the data storage unit 116 via the control unit 105, and the counters 111, 112, and 113 are thus preset. Values corresponding to the amounts of feed are displayed in the display unit 115 at the same time.

During the operation of the sewing machine, the sewing motor 8 drives the main shaft 6 via the V-belt 7. The main shaft moves the needle bar 14 up and down via the drive connection formed by the crank 11 and the connecting rod 12. The main shaft 6 also drives the shuttle (not shown) via the toothed belt 9 and the shuttle drive shaft 10. The drive for feeding the part to be sewn is always generated, via the pulse generator 101, when the needle 13 is penetrating into the part to be sewn and when it again leaves the part to be sewn. The pulse generator 101 sends an impulse to the control unit 105 on passage of the impulse marking 104 through the pulse generator 101. The control unit now switches the potential on the inputs E2 of the AND gates 107, 108, and 109 to High via the control lines 107*a*, 108*a*, and 109*a*. The impulses subsequently sent by the pulse generator 102 on passage of the impulse markings 103, will now be transmitted by the AND gates 107, 108, and 109 to the counters 111, 112, and 113 via the selector 106 which is switched by the control unit 105 via the line 106*a* to input E2 during the drive of the sewing machine.

When one of the counters 111, 112 or 113 has reached the count "0", it sends a control impulse to the corresponding power amplifier 117, 118 or 119, as a result of which the corresponding stepping motor 23, 42 or 96 is tripped by one step of rotation. At the same time, this counter 111, 112 or 113 sends an impulse via a corresponding control line 111*a*, 112*a* and 113*a* to the control unit 105, which again presets this counter 111, 112 or 113 to a new value. The control unit 116 now polls the corresponding values from the data storage unit 116. At the same time, via the control lines 117*a*, 118*a*, and 119*a* connected to the power amplifiers 117, 118, and 119, the control unit determines whether the corresponding stepping motor 23, 42, and 96 is moved in the forward or reverse direction of rotation. On the passage of the second impulse marking 104 through the pulse generator 101, the process described is repeated. The stepping motors 23, 42 and 96 thus perform their predetermined number of steps and consequently the above-mentioned half amount of feed within half of one revolution of the pulse disk 100. The values that can be preset on the counters 111, 112, and 113 are selected so that the stepping motors 23, 42, and 96 can perform their maximum number of steps both during the phase in which the needle 13 has been removed from the fabric being sewn and during the phase in which the needle 13 has entered the fabric.

The tripping impulses acting on the stepping motors 23, 42, and 96 drive the rocker arm 17, the pushing wheel 47, and the rolling foot 80 to exert a joint feeding effect on the part being sewn. The stepping motor 42 now rotates the pushing wheel 47 via the upright shaft 38 that is rigidly coupled with its drive shaft 43 and via the Spiroid gear mechanism 45. At the same time the stepping motor 96 drives the rolling foot 80 via the shaft 90 that is rigidly coupled with its drive shaft 95 and the Spiroid gear mechanism 83. Also at the same time, the stepping motor 23 rotates the eccentric 21 stepwise in one direction via its drive shaft 22. The eccentric 21 transmits deflecting movements to the rocker arm 17 via the eccentric rod 20 and the lever arm 18. As a result of which the rocker arm 17 will swivel through corresponding angles. With the needle 13 in the fabric, this swivel takes place synchronously with the feed of the pushing wheel 47 and the rolling foot 80. When the needle 13 has been withdrawn from the fabric, this swivel is brought about by driving the eccentric 21 in the opposite direction.

The needle bar 14 is known to perform a sinusoidal oscillating movement in the direction of feed. It oscillates in the direction of feed during its phase in which it is within the fabric and in the opposite direction during the phase in which it is withdrawn from the fabric. The control device of the stepping motor 23 for swiveling the needle bar 14 is therefore designed so that during one revolution of the main shaft 6, i.e., during each feed between two stitch formations, it generates two sinusoidal component step sequences. One step sequence drives the stepping motor 23 in the direction of feed and the other drives the motor in the opposite direction. The stepping motors 42 and 96 for the pushing wheel 47 and the rolling foot 80 are advantageously also driven in two sinusoidal component step sequences rather than in a constant step sequence.

After the individual stepping motors 23, 42, and 96 have performed the numbers of steps in accordance with the data set on the keyboard 114 and polled correspondingly from the data storage unit 116, the input E2 of the corresponding AND element 107, 108 or 109 is switched by the control unit 105 via the control line 107*a*, 108*a* or 109*a* to potential L. Thus the further transmission of the tripping impulses from the pulse generator 102 is prevented by the corresponding AND element 107, 108 or 109.

To secure the stitch formation, the control unit 105 displaces the axis of the needle 13 into the end zone of the stitch slot 50*b* in the needle plate 50 prior to each sewing operation. To do so, the control unit 105 tests the state of the sewing motor 8 and the speed set value generator 127 via the transfer bus 126*a*. When the sewing motor 8 is stopped, the control unit 105 sends a signal via the transfer bus 126*a* to the motor control device 126, which will at first prevent the sewing motor 8 from being started.

During normal stitch formation, the amplitude of oscillation of the needle 13 around the center line M of the stitch slot 50*b* equals S/2 in which S is one full stitch length. From the stitch length S entered via the keyboard 114, the length L of the stitch slot 50*b* in the needle plate 50, and a selectable value K which corresponds to a residual or minimal distance between the needle 13 and the end of the stitch hole 50*b*, the control unit 105 calculates a displacement value W, at which the first entry of the needle 13 into the fabric is to take place during the next sewing operation. The displacement W of the needle 13 into the end zone of the stitch slot 50*b* from the center line M consequently equals L/2 minus half the amplitude of the oscillation S/2 minus the residual or safety distance K which the needle must keep from the end of the stitch slot. Thus, $W=L/2-S/4-K$.

For the first entry of the needle 13 cooperating with the pushing wheel 47 and the rolling foot 80, the control unit 105 reads from the data storage unit 116 corresponding digital values which correspond to the calculated value W, and thus brings about presetting of the counters 111, 112, and 113 via the transfer bus 110. The control unit 105 subsequently switches the selector 106 to F1, so that the impulses or High or Low values sent by the oscillator 123 can be transmitted to the inputs E1 of the AND gates 107, 108, and 109 in order to prompt a sewing operation with the sewing motor 8 stopped.

As soon as the control unit 105 receives the information via the control device 126 that the speed set value generator 127 is actuated, it switches the potential on the inputs E2 of the AND gates 107, 108, and 109 to High via control lines 107*a*, 108*a*, and 109*a*. The impulses sent by the oscillator 123 will now be transmitted to the counters 111, 112, and 113 via the selector 106 located in front of the AND gates 107, 108, and 109. The selector is switched to the input F1 when the sewing motor 8 is stopped.

The stepping motors 23, 42, and 96 will move in the above-described manner until the number of steps preset in the data storage unit 116 for driving the pushing wheel, the rolling foot, and the needle has been carried out. The inputs E2 of the corresponding AND gates 107, 108 or 109 are now switched by the control unit 105 to potential Low via the control line 107*a*, 108*a* or 109*a*, so that the further transmission of the timing impulses from the pulse generator 102 is prevented by the corresponding AND element 107, 108 or 109. At the same time, the sewing motor 8 is restarted via the collecting line 126*a*. The axis of the needle 13 has been swiveled by the value W and S/4 to the position S1 (FIG. 7) from the middle position M.

Via the transfer bus 128*a*, the counter 128 is loaded with a preselectable digital signal, which corresponds to the number of initial stitches that are to be made during the starting phase of sewing, after which the needle bar 14 is to return into its normal sewing position in the middle of the stitch slot 50*b*.

The selector 106 is switched by the control unit 105 to F2, so that the impulses sent by the impulse generator 102 will be transmitted to the inputs E1 of the AND gates 107, 108, and 109. However, data is input into the counters 111, 112, and 113 for performing the first stitch.

The motor control device 126 now drives the sewing motor 8 at the speed preselected by the speed set value generator 127. The first stitch is formed without feed, because the counters 111, 112, and 113 contain no data that would cause the stepping motors 23, 42, and 96 to be driven.

Figure 7:
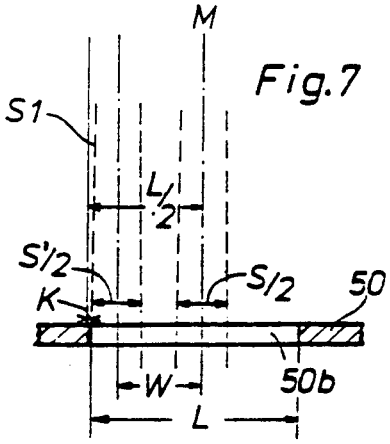
FIG. 7 is an enlarged detail from FIG. 4.
Figure 6:
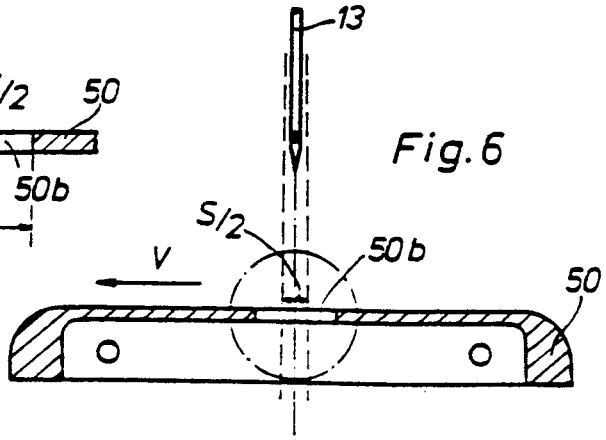
FIG. 6 is an enlarged sectional view through the needle plate of the sewing machine.

After the first stitch, the further stitches are made with the stitch length S entered via the keyboard 114 in the above-described manner by polling corresponding data from the data storage unit 116, and the needle performs its feed motion in the range designated by S'/2 in FIG. 7, so that satisfactory stitch formation takes place even during the first stitch. The counter 128 counts down by "1" on each stitch. As soon as the counter 128 reaches "0", the formation of the initial stitches is terminated. The counter 128 sends an impulse to the control unit 105 via the line 128*b*, after which, during the withdrawal of the needle 13 from the fabric being sewn, the next impulse of the pulse generator 101 induces a movement which causes the axis of the needle 13, the pushing wheel 47, and the rolling foot 80 to be moved back before the next stitch by the same amount by which they were moved forward in the direction of feed prior to the sewing operation. Thus, the needle 13 will again swing out during the further stitch formation in the middle zone of the stitch hole 50*b* of the needle plate 50 designated by S/2 in FIG. 7.

Figure 5:
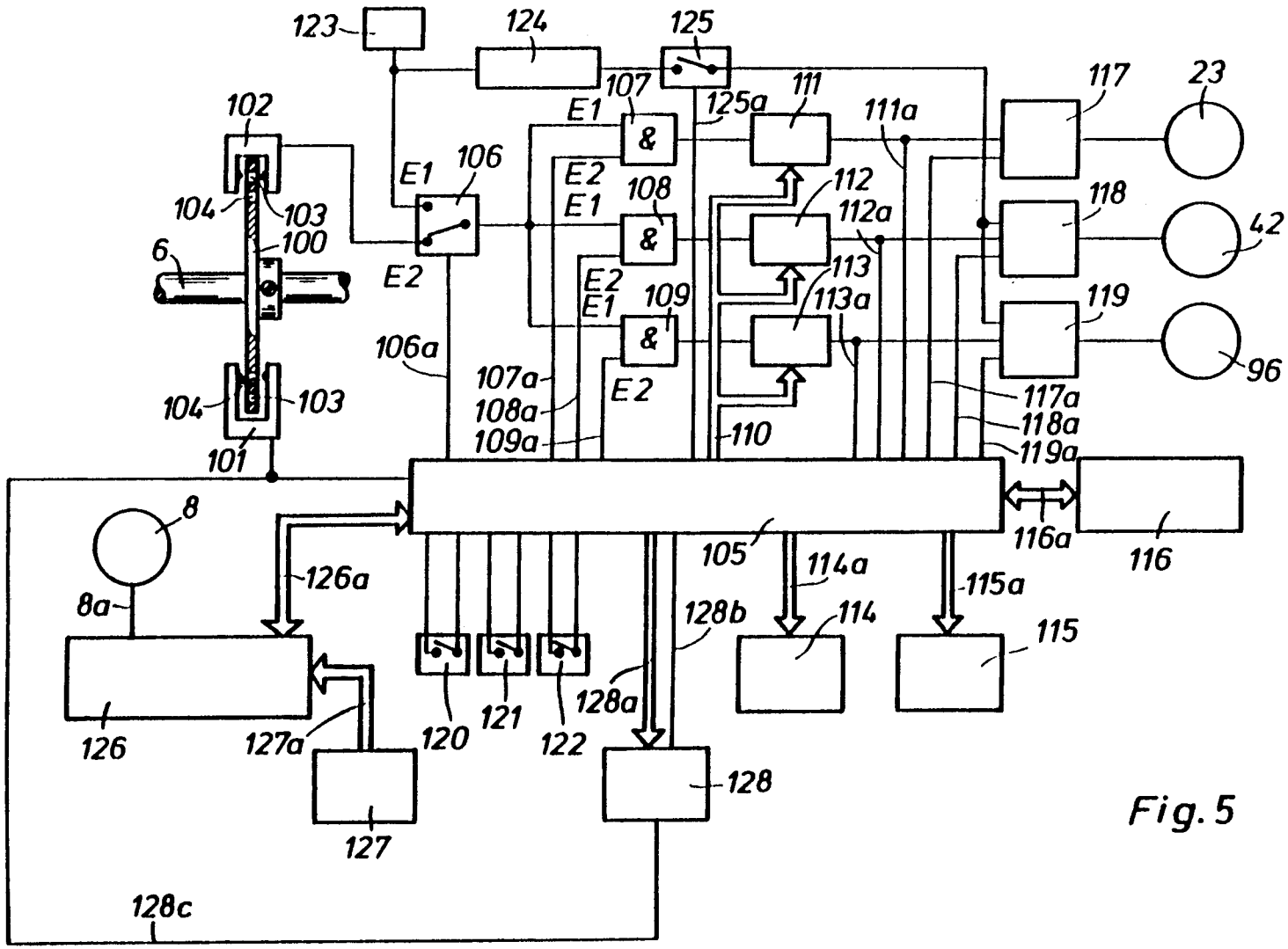
FIG. 5 is a block diagram of the electronic circuitry for the feed mechanism.
Figure 8:
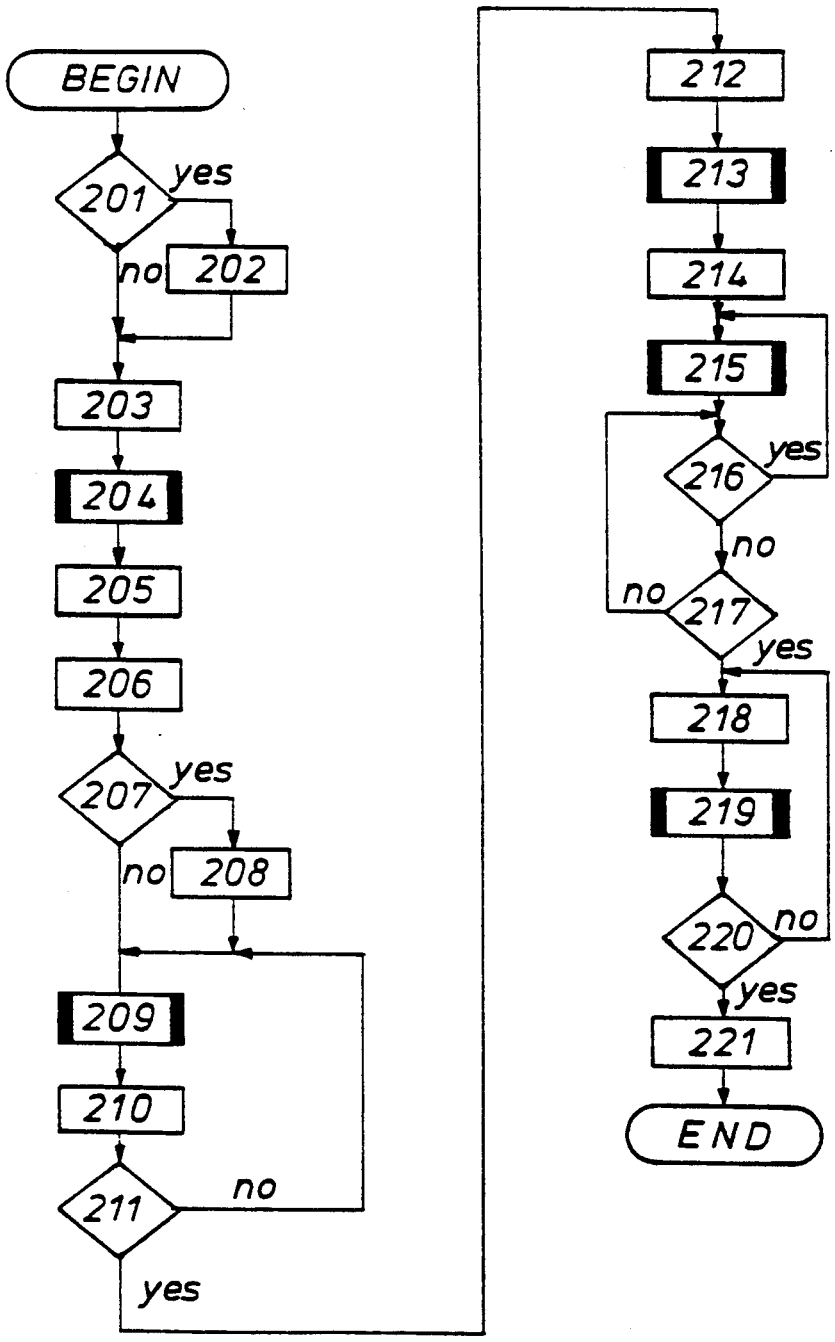
FIG. 8 is a flow chart of the control process of the sewing machine.

FIG. 8 shows a flow chart of the control process of the sewing machine, as is controlled by the control unit 105 of the circuit shown in FIG. 5.

After the sewing machine is started by switching on a main switch (not shown), polling is performed to determine whether the stitch length was changed 201. If it was changed, the control unit 105 calculates a new displacement value W 202; otherwise, the previous displacement value W is retained. For safety's sake, the sewing motor 8 is then switched off 203. Oscillator drive subroutine 204 (FIG. 10) of the stepping motors 23, 42, and 96 is now performed to displace the rocker arm 17 of the needle 13 to the end of the stitch slot 50*b* by the displacement value W from the middle M (FIG. 7).

During this oscillator drive, the selector switch 106 is switched to F1 239, and the AND gates 107, 108, and 109 are switched to "ON" 240. The counters 111, 112, and 113 are loaded with data values to generate the displacement of the rocker arm 17 by the displacement value W 241. A polling is performed to determine whether the displacement is a reverse displacement 242. If it is not, a polling is performed to determine whether an impulse from the oscillator 123 is present 244. Each counter 111, 245, 112, 244, and 113, 251 will then count down by "1" under the effect of the successive impulses from the oscillator 123. In the next step, the counters 111, 246, 112, 249, and 113, 252 are checked to determine whether their values equal "0". If not, the next impulse of the oscillator 123 is awaited in step 244. If one of the counters 111, 112, 113 is at "0", the corresponding stepping motor 23, 42, or 96 is tripped by one step in the steps 247, 250 or 253.

A polling is now performed 254 to determine whether the displacement of the rocker arm 17 has been completed. If not, the counters 111, 112, and 113 are set to new data values in step 255, and the count down process is repeated until the displacement is complete. Another polling is now performed 256 to determine whether a reverse displacement is present. If the displacement is not a reverse displacement, the selector switch 106 is switched to F2 and the AND gates 107, 108, and 109 are switched to "OFF" 259. The subroutine will thus return to step 205 in FIG. 8.

Counter 128 is set to the number of initial stitches here 205, and the sewing motor 8 is connected 206.

A polling is now performed 207 to determine whether this is the first stitch formation after the beginning of the sewing process. If yes, the counters 111, 112, and 113 are set to "0" 208. Regardless of whether the result of the polling was "YES" or "NO", a stitch is now performed 209, as will be described below on the basis of FIG. 9. If this is the first stitch formation, no feed of the fabric to be sewn is brought about by the stepping motors 23, 42, and 96, because the counters 111, 112, and 113 were set to "0".

After the stitch has been prepared, the counter 128 counts down by "1" 210, and a polling is performed to determine whether it is at "0" 211. The stitch formation is now continued until the counter 128 reaches "0", after which the sewing motor 8 is again turned off 212. The initial stitches to be prepared in the end zone of the stitch slot 50*b* have thus been prepared.

An oscillator drive 213 of the stepping motors 23, 42, and 90 is now again performed to displace the rocker arm 17 of the needle 13 back to the middle M of the stitch slot 50*b* by the displacement value W. The process takes place according to the flow chart shown in FIG. 10, but this time it is determined in step 242 that the displacement is a reverse displacement and switching over of the power amplifiers 117, 118, and 119 is now performed in step 243 via the lines 117*a*, 118*a*, and 119*a* in order to reverse the displacement of the rocker arm 17. The switching over of the power amplifiers 117, 118, and 119 is also abolished in step 257.

Figure 9:
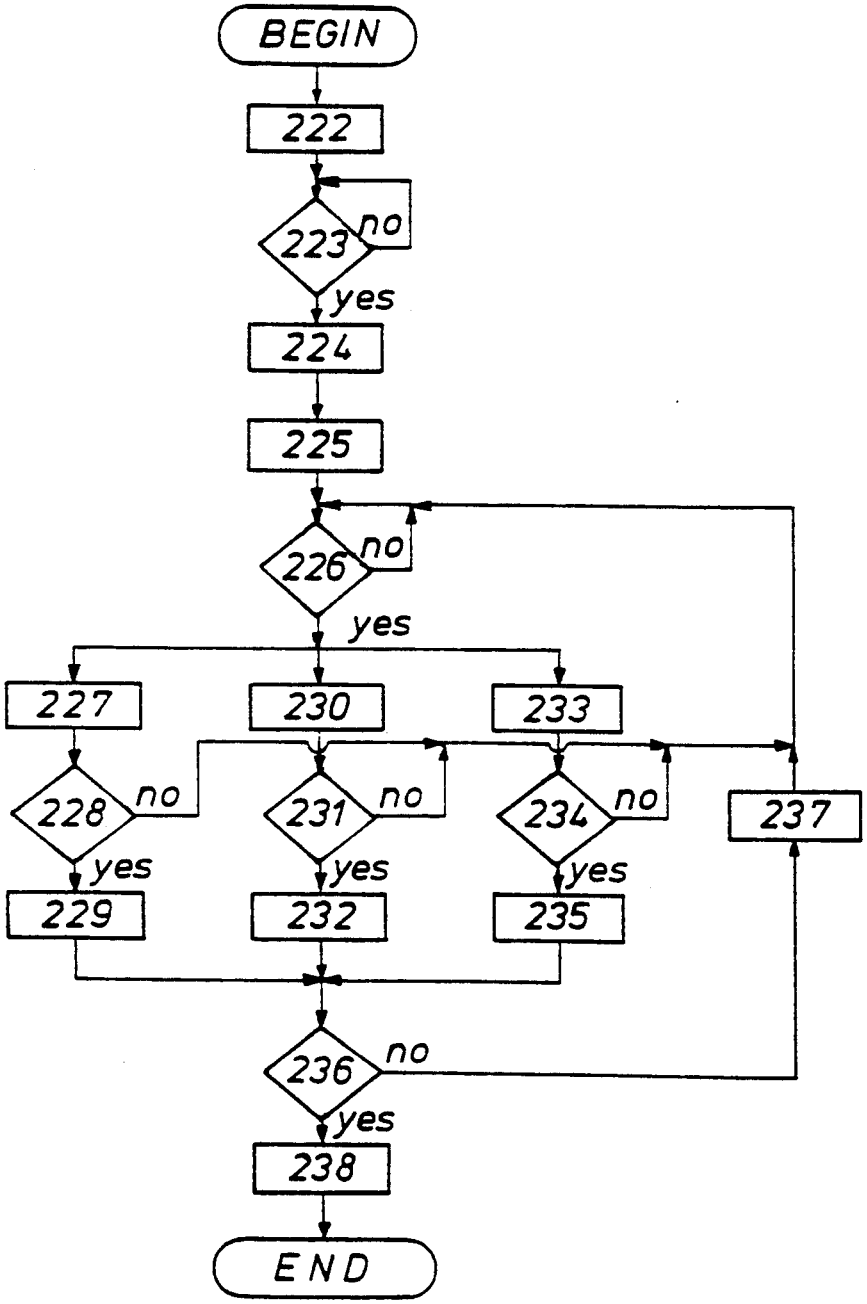
FIG. 9 is a flow chart describing the stitch formation process.

After completion of the displacement of the rocker arm 17, the sewing motor 8 is again turned on 214, and normal sewing stitches according to the subroutine 215 corresponding to FIG. 9 are now prepared.

Figure 10:
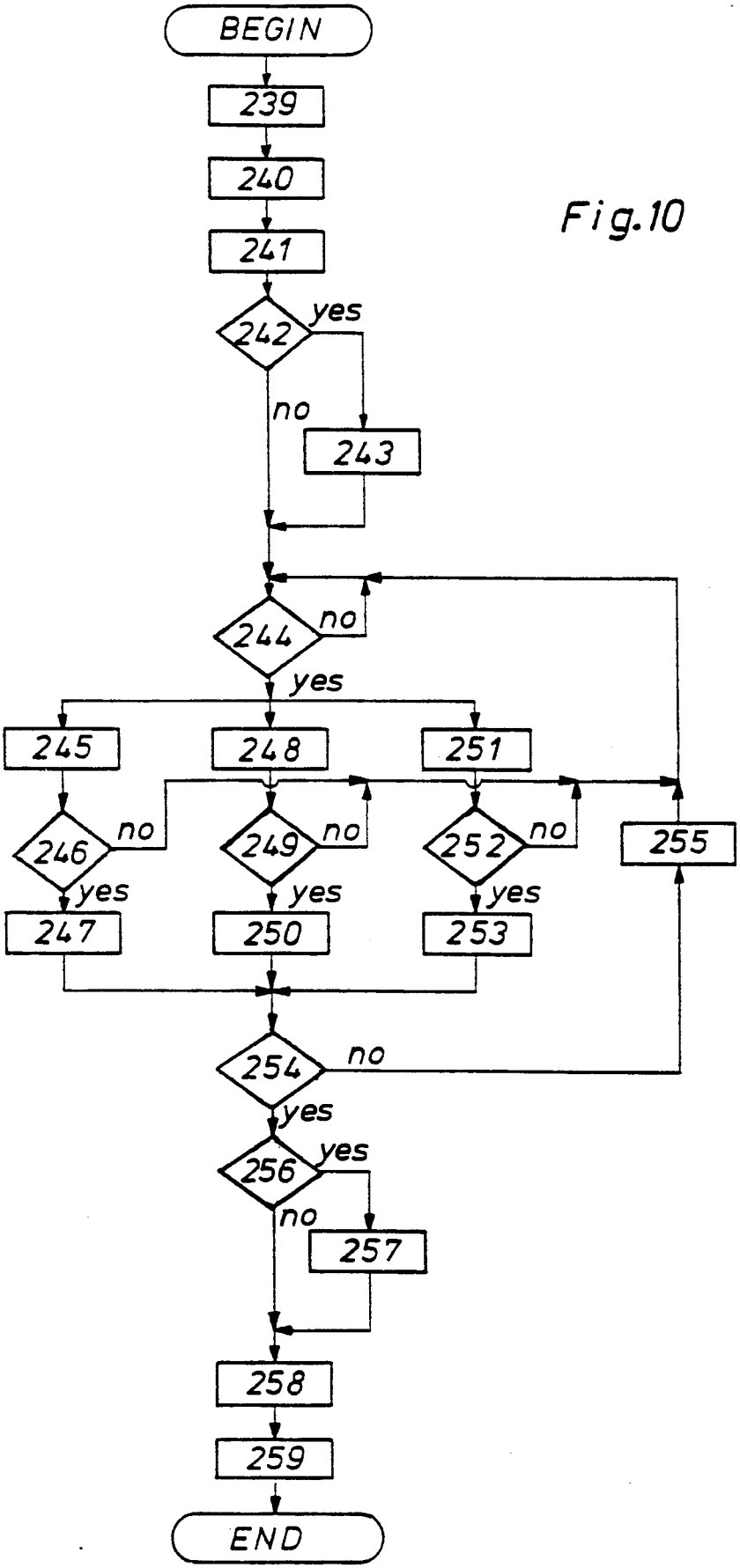
FIG. 10 is a flow chart of the process where the oscillator drives the stepping motors.

After each completed stitch formation, a polling is performed 216 to determine whether the speed set value generator 127 is still being actuated. As long as it is actuated, one more stitch is prepared. It the set value generator 127 is not actuated, a polling is performed 217 to determine whether the presser foot was raised and consequently sewing was terminated. If yes, the sewing motor 8 is turned off 218, and the oscillator drive subroutine 219 according to FIG. 10 is performed, and the stepping motors 23, 42, and 96 are consequently driven via the oscillator 123 in the above-described manner as long as the needle 13 stands in its upper position 220, after which the AND gates 107, 108, and 109 are switched to "OFF" 221.

The stitch formation according to FIG. 9 is performed by first switching the selector switch 106 to F2 222. A polling is then performed to determine whether an impulse from the pulse generator 101 223 is present. As soon as such an impulse is present, the AND gates 107, 108, and 109 are switched to High 224. The data values for the stitch length are loaded into the counters 112, and 113, 225. In the presence of an impulse from the pulse generator 102, 226, the counters 111, 227, 112, 230, and 113, 233 count down by "1". This happens until they reach "0" 228, 229, 234, after which the stepping motors 23, 42, and 96 each perform one step 229, 232, and 235.

A testing is then performed to determine whether the intended stitch feed has been completed by all three stepping motors 23, 42, and 96 236. If not, the next data values are loaded into the counters 111, 112, and 113 237, after which—at the next impulse of the pulse generator 102—the described countdown process of the counters 111, 112, and 113 is performed, and the yet-to-be-performed steps of the stepping motors 23, 42, and 96 are performed long as the stitch feed set is being performed. The AND gates 107, 108, and 109 are then switched to "OFF" 238, and stitch formation of an individual stitch is terminated.

The switch 120 in FIG. 5 is used for short-term reverse sewing during stitch formation, i.e., when the selector 106 is switched to F2 and the AND gates 107, 108, and 109 are switched to "ON". Switch 120 will now only switch over the power amplifiers 117, 118, and 119 via the lines 117*a*, 118*a*, and 119*a* in order to reverse the drive of the stepping motors 23, 42, and 96, respectively, and consequently the feed as well.

The two switches 121 and 122 are used to slowly drive the stepping motors 42 and 96 in the forward and reverse direction during stoppage of the machine, when the needle 13 is in the high position. On actuating one of the two switches 121 or 122, the switch 125 is closed by the control unit 105, so that via the divider 124, which passes through only a reduced part of the impulses of the oscillator 123, these reduced impulses are sent via the oscillator 123 to the two power amplifiers 118 and 119. On actuating switch 122, the two power amplifiers 118 and 119 are also switched over at the same time via the lines 118*a* and 119*a* in order to reverse the direction of the feed to be performed.

The captions for the individual boxes are here now listed.

201 = Has stitch length been changed?
202 = Calculate new W value
203 = Sewing motor 8 off
204 = Oscillator drive subroutine
205 = Set counter 128 to the number of initial stitches
206 = Sewing motor 8 on
207 = First stitch formation?
208 = Set counters 111, 112, and 113 to "0"
209 = Stitch formation subroutine
210 = Counter 128: n = n − 1
211 = Has counter 128 been set to "0"?
212 = Sewing motor 8 off
213 = Oscillator drive subroutine
214 = Sewing motor 8 on
215 = Stitch formation subroutine
216 = Has speed set value generator 127 been actuated?
217 = Is presser foot in top position?
218 = Sewing motor 8 off
219 = Oscillator drive subroutine
220 = Is needle in top position?
221 = AND gates 107, 108, and 109 "OFF"
222 = Selector 106 to F2
223 = Impulse from pulse generator 101?
224 = AND gates 107, 108, 109 to High
225 = Load data values into counters 111, 112, and 113
226 = Impulse from pulse generator 102?
227 = Counter 111: n = n − 1
228 = Counter 111: n = 0?
229 = Stepping motor 23 performs one step
230 = Counter 112: n = n − 1
231 = Counter 112: n = 0?
232 = Stepping motor 42 performs one step
233 = Counter 113: n = n − 1
234 = Counter 113: n = 0?
235 = Stepping motor 96 performs one step
236 = Has stitch feed been completed?
237 = Load new data value into counters 111, 112, and 113
238 = AND gates 107, 108, and 109 to High
239 = Selector 106 to F1
240 = AND gates 107, 108, and 109 to Low
241 = Load data values into counters 111, 112, and 113
242 = Reverse displacement?
243 = Switching over of the power amplifiers 117, 118, 119
244 = Impulse from oscillator 123

245 = Counter 111 : n = n − 1
246 = Counter 111: n = 0?
247 = Stepping motor 23 performs one step
248 = Counter 112: n = n − 1
249 = Counter 112: n = 07
250 = Stepping motor 42 performs one step
251 = Counter 113: n = n − 1
252 = Counter 113: n = 0?
253 = Stepping motor 96 performs one step
254 = Has displacement of the rocker arm 17 been concluded?
255 = Load new data values into counters 111, 112, and 113
256 = Reverse displacement?
257 = Switching over of the power amplifiers 117, 118, 119
258 = Selector 106 to F2
259 = AND gates 107, 108, and 109 to Low If the sewing operation is begun with a stitch sequence extending in the reverse direction, when, e.g., the button 120 for reverse sewing is actuated at the beginning of sewing the control device 105 shifts the axis of the needle 13 into the front area of the stitch hole 50*b* of the needle plate 50, i.e., into the area directed toward the sewing machine operation. The initial stitches are then made in a reversed feed direction analogously to the above-described embodiment in normal feed setting, after which the axis of the needle 13 is displaced into its middle area.

According to another embodiment of the present invention, it is also possible to stop the needle 13 during the preparation of the initial stitches by setting the counter 111 to "0" during this time. During the preparation of these initial stitches the material to be sewn is fed exclusively by the pushing wheel 47 and the rolling foot 80.

When the needle 13 leaves the material being sewn in the end zone of the stitch hole 50*b* after performing the first sewing stitch, the impulse now generated by the pulse generator 101 causes, via the control unit 105, the needle bar guide 17 to stop. At the same time, during the phase in which the needle 13 has been withdrawn from the fabric, the control unit 105 controls the entire feed motion of the pushing wheel 47 and the rolling foot 80 to prepare a stitch with the stitch length S set, while it prevents the pushing wheel 47 and the rolling foot 80 from being fed during the phase in which the needle 13 has penetrated into the fabric.

This stitching operation is performed until the counter 128 (FIG. 5), on which the number of initial stitches has been preselected, has been reset and it sends an impulse to the control unit 105 via the line 128*b*.

As was described in connection with the preceding embodiment, this impulse induces the reverse movement of the needle 13, and the needle is moved to above its next point of penetration into the fabric to be sewn. The further stitch formation is then again performed in the middle areas of the stitch hole 50*b* of the needle plate 50.

For reverse sewing, e.g., for bar tacking at the end of the seam, the switch 120 is actuated. As a result of this the control unit 105 reverses the direction of rotation of the stepping motors 23, 42, and 96 at the beginning of a new impulse sent by the impulse generator 101, via the control lines 117*a*, 118*a*, and 119*a* to the power amplifiers 117, 118, and 119, so that the stepping motors will drive the pushing wheel 47, the rolling foot 80, and the needle bar 14 in the opposite direction as long as the switch 120 is being actuated. The stepping motors 23, 42, and 96 now perform the sequence of steps in the above-described manner by polling the corresponding values set via the keyboard 114 from the data storage unit 118.

During the stopping of the sewing machine, which usually ends at the top dead center of the needle 13, the control unit 105 switches the selector 106 to an input F1, so that the impulses generated by the oscillator 123 are sent to the inputs E1 of the AND gates 107, 108, and 109. As soon as the sewing machine stops, timing impulses are sent from the oscillator 123 to the inputs E1 of the AND gates 107, 108, and 109 instead of the timing impulses from the pulse generator 102. Thus, the preselected feed of the needle 13, the pushing wheel 47, and the rolling foot 80 is completed even after the last withdrawal of the needle 13 from the fabric being sewn, so that the needle 13 is already located above the location of the next needle penetration. As soon as the end position of the preselected amount of feed has been reached, the control unit 105 switches off the AND gates 107, 108, and 109 via the control lines 107*a*, 108*a*, and 109*a*.

We claim:

1. A process for forming a sewing operation, the process comprising:
   displacing a needle into an end zone of a stitch slot;
   performing a preselected number of initial stitches in said end zone; moving said needle into a normal middle sewing position of said stitch slot from said end zone; and
   correcting subsequent feed motions of the sewing operation for said displacement of said needle into said end zone.

2. A process in accordance with claim 1, wherein:
   said needle performs a feed motion corresponding to a feed motion of a fabric simultaneously with said performing of said initial stitches.

3. A process in accordance with claim 1, wherein:
   said needle is stopped in said end zone and a fabric is moved by feed means only when said needle is withdrawn from said fabric; and
   after said moving of said needle into said normal middle sewing position of said stitch slot, said needle is moved in coordination with said feed means for performing said subsequent feed motions when said needle has penetrated said fabric and when said needle is withdrawn from said fabric.

4. A process in accordance with any one of claims 1, 2 or 3, wherein:
   a first stitch of said initial stitches is formed without a feed motion.

5. A process for performing a sewing operation with a sewing machine equipped with a control unit driving both a lower and/or upper feed means for performing a feed movement of a fabric, and the sewing machine being equipped with a needle plate which has a stitch slot, the process comprising the steps of:
   driving stepping motors to move the fabric and a needle from a normal middle position of the stitch slot into an end zone of the stitch slot without executing stitch operations;
   executing normal stitch operations in said end zone of the stitch slot;
   driving stepping motors to return said needle and the fabric from said end zone of the stitch slot to said normal middle position of the stitch slot without executing stitch operations; and
   executing normal stitch operations in said normal middle position of said stitch hole.

* * * * *